United States Patent [19]

Nishikawa

[11] 4,260,242

[45] Apr. 7, 1981

[54] ELECTROPHOTOGRAPHIC APPARATUS FOR FORMING A DUPLICATED IMAGE AT ANY DESIRED POSITION ON A RECORD CARRIER

[75] Inventor: Masaji Nishikawa, Hachioji, Japan

[73] Assignee: Olympus Optical Co., Ltd., Tokyo, Japan

[21] Appl. No.: 44,969

[22] Filed: Jun. 4, 1979

[30] Foreign Application Priority Data

Jun. 8, 1978 [JP] Japan ..... 53/68254

[51] Int. Cl.[3] ..... G03G 15/00

[52] U.S. Cl. ..... 355/14 TR; 355/3 TR; 355/3 SH

[58] Field of Search ..... 355/3 R, 3 TR, 3 SH, 355/7, 14 R, 14 SH, 14 TR, 14 C

[56] References Cited

U.S. PATENT DOCUMENTS

| | | | |
|---|---|---|---|
| 3,944,360 | 3/1976 | Deetz et al. | 355/14 C |
| 4,187,024 | 2/1980 | Satomi et al. | 355/14 R |

*Primary Examiner*—Richard L. Moses

*Attorney, Agent, or Firm*—Haseltine and Lake

[57] ABSTRACT

An electrophotographic apparatus comprising a sheet like document feed device for feeding a sheet like document through an exposure and scanning section at a constant speed, an optical system for illuminating the document at the exposure and scanning section and projecting a document image onto a rotatably arranged photosensitive drum to form an electrostatic charge image on the drum, a developing device for developing the charge image with toners to form a toner image, a transfer roller for transferring the toner image onto a record paper which is supplied from a paper cassette by means of a paper feeding device, and means for shifting operational timings of the document feed device and optical system and/or the paper feeding device with respect to the rotational movement of photosensitive drum, whereby the duplicated toner image may be formed at any desired position on the record paper viewed in its feeding direction.

15 Claims, 10 Drawing Figures

ELECTROPHOTOGRAPHIC APPARATUS FOR FORMING A DUPLICATED IMAGE AT ANY DESIRED POSITION ON A RECORD CARRIER

BACKGROUND OF THE INVENTION

This invention relates to an electrophotographic apparatus for forming or printing a duplicated image of a document at any desired position on a record carrier comprising means for exposing or exposing and scanning the document to produce an imagewise modulated light ray, a charge retentive member for retaining an electrostatic charge image formed thereon on the basis of said imagewise modulated light ray, means for driving the charge retentive member through a transfer section, means for feeding a record carrier through the transferring section at which the record carrier is positioned opposite to the charge retentive member, and means for transferring the charge image with or without being developed with toners onto the record carrier at said transferring section.

In known electrophotographic apparatuses the following means have been used for exposing or exposing and scanning a document to be copied onto an electrophotographic photosensitive member.

(1) A document is placed on a reciprocally movable document table and is exposed and scanned by a fixedly arranged optical system.

(2) A document is placed on a fixedly arrangement document table and is exposed and scanned by a movably arranged optical system.

(3) A document is placed on a fixedly arranged document table and is exposed by a fixedly arranged optical system in a one-shot manner.

(4) A document is fed by a document feed device comprising document feed rollers and is exposed and scanned by a fixedly arranged optical system.

(5) A document is fed to a given position on a document table by a document feed device comprising a feed belt which moves on the table along its surface and then is exposed and scanned by a movable optical system.

(6) A document is fed into a given position on a document table by a document feed device and is then exposed by a fixedly arranged optical system in a one-shot manner.

The exposing device and the exposing and scanning device belonging to the above mentioned groups (1) to (3) can be generally used, because they can handle thick documents such as books as well as thin sheet like documents. While the exposing or exposing and scanning devices of the groups (4) to (6) are mainly used for the thin sheet like documents, and have a special advantage that they can handle the sheet like documents in a very efficient manner. For the sake of simplicity the exposing device and the exposing and scanning device will be termed as an exposure-scanning device hereinafter.

With the aid of the exposure-scanning device an electrostatic charge image corresponding to the document image is formed on a charge retentive member such as an electrophotographically photosensitive member. Then the charge image is transferred onto a record carrier such as a record paper with or without being developed with toners. For the sake of simplicity the charge image and the toned image on the charge retentive member are sometimes termed as a duplicated image. In the known electrophotographic apparatus the exposure-scanning means, means for driving the charge retentive member and means for feeding the record carrier to the transferring section are always controlled in a fixedly operable manner relative to each other. That is to say they are so constructed and controlled that a front end of the duplicated image corresponding to a front end of the document image should always coincide with a front end of the record paper.

In practice one side edge of the record paper should be remained without being copied in order to obtain a space for binding, and the document image or a portion thereof should be duplicated at a given position on the record paper. In case of using the exposure-scanning means belonging to the groups (1) to (3) since the document can be placed on the document table at any desired position the above mentioned variations can be achieved to some extent. As shown in FIG. 1 the document table 1 of such an exposurescanning means comprises a glass stage 2. One side edge 3 of the glass stage 2 is made coincident with one side edge of an effective picture frame and corresponds to the front edge of the record paper. Therefore if a document 4 shown by a broken line in FIG. 1 is placed on the table with its one side being made coincident with the edge 3 of the glass stage 2, the duplicated image of the document can be formed at a given position on the record paper.

There is further provided on the document table a mark or stopper (not shown) for positioning the document in a direction perpendicular to the edge 3. Usually the document table 1 is made flat and the document can be displaced on this flat surface in orthogonal directions shown by double arrows A and B. Therefore it is possible to form a duplicated image at any desired position on the record paper. However in this case it is quite difficult to place the document on the table at such a position that in the final copy the image of the document will be formed at a desired position on the record paper. Particularly if it is required to form a portion of the document image at a center position or deviated position on the record paper, the operation for placing the document on the table becomes extremely cumbersome, because in this case the document has to be set on the table with masking the document except for the given desired portion to be duplicated with a white paper or with folding the document in such a manner that the given portion to be copied is exposed.

In the known electrophotographic apparatus comprising the exposure-scanning means of the groups 4) to 6) the position of the document image on the record paper could not be displaced with respect to the paper viewed in the paper feeding direction. In the direction perpendicular to the paper feeding direction the position of the image on the paper can be displaced to some extent by inserting the document at a shifted position in the relevant direction.

In this manner in the known electrophotographic apparatuses the position of the duplicated image with respect to the record carrier could not be shifted at will, particularly in the feeding direction of record carrier.

SUMMARY OF THE INVENTION

The present invention has for its object to provide a useful electrophotographic apparatus in which a position of duplicated image on a record carrier can be shifted at will particularly in a direction of feeding the record carrier.

It is another object of the invention to provide an electrophotographic apparatus comprising a document feed device and the duplicated image can be formed at any desired position on the record carrier viewed in the record carrier feeding direction.

According to the invention an electrophotographic apparatus of the kind mentioned in the preamble further comprises means for shifting at least one operational timings of the exposure-scanning means, the charge retentive member driving means and the record carrier feeding means in such a manner that the charge image can be transferred at any desired position on the record carrier viewed in the feeding direction of record carrier.

In a preferred embodiment of the electrophotographic apparatus according to the invention the apparatus further comprises a document feeding device for feeding the document to such a given position on a document table that the duplicated image could be formed at a given position on the record medium, if none of the operational timings of the exposure-scanning means, the charge retentive member driving means and the record carrier feeding means is not shifted.

DESCRIPTION OF THE PREFERRED EMBODIMENTS

Figure 2:
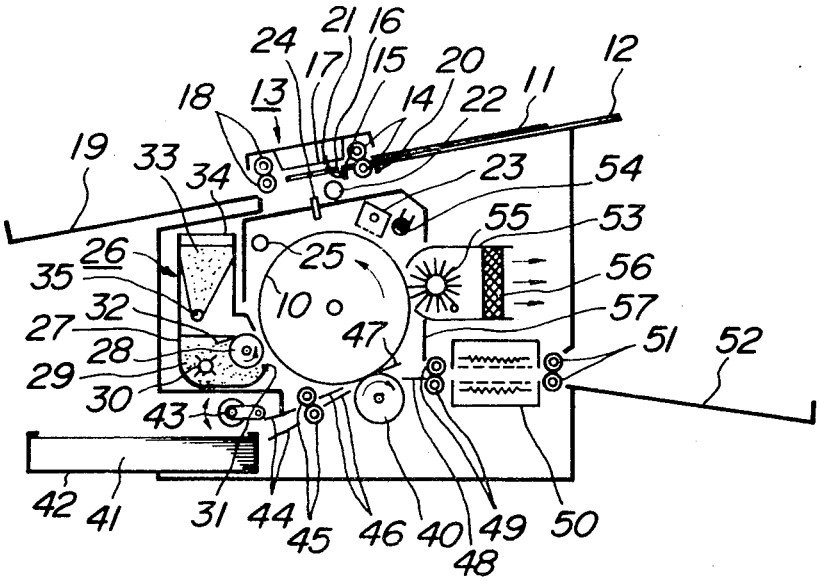
FIG. 2 is a schematic diagram illustrating an embodiment of an electrophotographic apparatus to which the present invention can be applied.

FIG. 2 shows schematically an embodiment of an electrophotographic apparatus to which this invention can be advantageously applied. In this embodiment a document is fed by a document feed device to an exposure section and is exposed and scanned, while it is fed by the feed device. The apparatus comprises a photosensitive drum 10 comprising an electrically conductive drum and a thin film applied on the drum and consisting of photosensitive material such as Se, Se alloy, PVK (polyvinyl carbazole) and TNF (trinitrofluorene), a composite thin layer of Se and PVK. The drum 10 is rotatably supported and is rotated in a direction shown by an arrow at a constant speed. A document 11 to be copied is placed on a document table 12 and is feed automatically when its front end is inserted into a document feed device 13. The document feed device comprises a pair of feed rollers 14 and a pair of discharge rollers 18. The document 11 is first fed by the rollers 14 along a document guide plate 15 arranged in line with the document table 12 between a glass plate 16 and a white reflecting plate 17 which form an exposure section. Then the document 11 is discharged by the rollers 18 onto a document tray 19.

Figure 3:
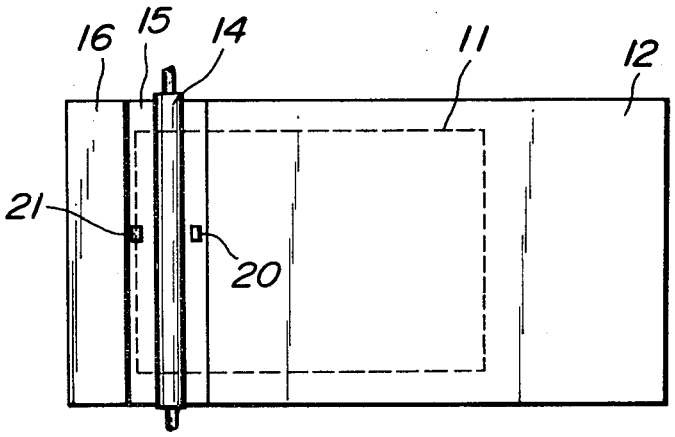
FIG. 3 is a plan view showing a major part of a document feed device of FIG. 2.

As shown in FIG. 3 on both sides of the document feed rollers 14 are arranged document detecting sensors 20 and 21, respectively. When the upstream sensor 20 detects the front edge of the document 11, the feed rollers 14 are driven and at the same time an illumination lamp 22 is made lighted on. While the document is fed, the downstream sensor 21 detects the front edge of document 11 and then the document feed rollers 14 are made once inoperative and the document is stopped at a stand-by position. As soon as the second sensor 21 detects the front edge of document, a corona charger 23 of a scorotron type is energized so as to electrify homogeneously the photosensitive drum 10 to a given potential. After the drum 10 has rotated by a given angle the document feed rollers 14 are made operative again and thus the document travels between the glass plate 16 and the reflecting plate 17 at a constant speed. During this travelling the document 11 is exposure-scanned. Finally the document is discharged on the document tray 19. In the present embodiment upon the actuation of a main switch (not shown) the drum 10 is made rotated by a given number of turns until the preparation for duplication has been completed. If the document is inserted in the feed device 13 during this preparation period, the document is remained at the stand-by position and as soon as the preparation period has been expired the document is fed again in synchronism with the rotation of drum 10. After the preparation has been completed when the document is inserted into the feed device 13, its front edge is first detected by the sensor 20 and then the photosensitive drum 10 begins to rotate. It should be noted that the document discharge rollers 18 are made always operative as long as the main switch is actuated.

While the document 11 travels on the glass plate 16 it is exposed by the lamp 22. An optical image of the document is projected onto the uniformly charged photosensitive drum 10 by means of a converging type optical fiber array 24 so as to form an electrostatic charge image on the drum surface. Then undesired charge on the drum 1 beyond an effective picture frame is erased by a trimming lamp 25. The charge latent image thus formed is developed with toners by a developing device 26. As the developing device use may be made of any kind of developer. In this embodiment a magnetic brush developer is used together with two component developing agent. The developer 26 comprises an envelope 27, a magnet roller 28 arranged rotatably in a direction shown by an arrow for applying the toner developing agent 29 to the drum surface, a rotating vane 30 for mixing toner particles and magnetic carriers in the developing agent 29, a doctor blade 27 for limiting or defining a length of the toner brush applied on the magnet roller 28 and a scraper 32 for scraping the developing agent off the magnet roller 28. The developer 26 further comprises a toner reservoir 34 for containing toners 33 and being arranged detachably or fixedly on the envelope 27 and a knurled roller 35 rotatably arranged at a bottom of the reservoir for supplementing a given amount of toners to the developing agent 29 so as to keep constant its toner concentration. The developing device 26 may be further provided with a developing electrode for applying a suitable developing bias voltage between the electrode and the drum 10 so as to control a concentration of a developed toner image.

The toner image thus formed on the drum 10 by means of the developing device 26 is transferred onto a record paper 41 at a transfer section at which the record paper is fed between the drum 10 and a transfer roller 40. The transfer roller is made of semiconductive resilient material such as conductive rubber and a suitable transfer bias voltage having the same polarity as that of the charge image is applied to the transfer roller for producing a transferring electric field between the roller and the drum 10. The magnitude of transferring electric field is so adjusted that the electrostatic charge image on the drum could not be damaged or deteriorated.

A number of record papers 41 are stuck in a paper cassette 42 and are fed successively to the transfer section by means of a rotating pick-up roller 43 which is swung up and down in synchronism with the rotation of the drum 10, a pair of paper guides 44, a pair of register rollers 45 for correcting the travelling timing and speed of the record paper, and a pair of paper guides 46. While the paper is fed between the drum 10 and the transfer roller 40 the toner image on the drum is transferred onto the paper. Then the record paper 41 is peeled off the drum 10 by means of one or more peeling claws 47 and an air stream (not shown). The record paper 41 is then fed to a fixing device 50 of an oven heater type by means of a paper guide 48 and a pair of feed rollers 49. The heater is energized as soon as the main switch is actuated and its temperature increases to a given level during the preparation period. There is provided a thermal control device for keeping the heater temperature at a given fixing temperature. The record paper 41 having the toner image thus fixed is discharged onto a copy discharge tray 52 by means of a pair of discharge rollers 51. The paper feed rollers 49 and 51 may be driven as soon as the main switch is made on.

The photosensitive drum 10 further rotates and is subjected to cleaning and erasing operations by means of a cleaning device 53 and an erasing lamp 54, respectively and thus residual toners and electrostatic latent image on the drum are removed. In this manner the drum 10 is prepared for a next duplicating operation. The cleaning device 53 comprises a rotating brush 55 which is arranged swingably between a first operative position in which the brush is made in contact with the drum 10 and a second inoperative position in which the brush is kept away from the drum 10. In the first operative position the brush 55 scrapes the toners off the drum 10 and the scraped toners are collected by a filter 56 with the aid of an air stream. This air stream may be used for scraping the record paper off the drum 10 as explained above.

In the electrophotographic apparatus according to this embodiment a number of copies can be printed from the single electrostatic charge image once formed on the photosensitive drum 10 by repeating the developing and transferring steps in succession. In this case after the duplication for the last copy has been started the cleaning device 53 and erasing lamp 54 are made operative. In order to protect the photosensitive drum 10 against undesired external light the drum 10 is surrounded by a shielding plate 57.

Figure 4:
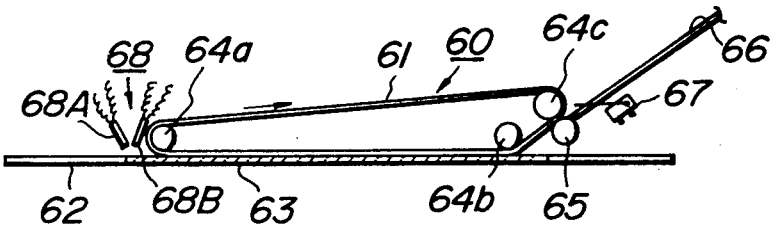
FIG. 4 is a cross section depicting another embodiment of a document feed device.

FIG. 4 is a cross sectional view illustrating another embodiment of the document feed device. In this embodiment the document feed device 60 comprises a flexible endless belt 61 which is rotatably supported by belt rollers 64*a*, 64*b* and 64*c*. A travelling path of the belt 61 includes a portion which is in parallel to a glass stage 63 of a document table 62. There is further provided a document feed roller 65 arranged opposite to the roller 64*c* and a document guide plate 66 which extends in a tangential direction of the roller 65. The document to be duplicated is clamped between the belt 61 and the feed roller 65 and is fed onto the glass stage 63. At an upstream position with respect to the roller 65 is provided a document detecting sensor 67 comprising a microswitch. Further at a downstream position above the glass stage 63 with respect to the roller 64*a* is arranged a photoelectric document detector 68 comprising a light source 68A and a light receiving element 68B.

When the sheet like document is inserted between the belt 61 and the roller 65 along the document guide plate 66, at first the microswitch 67 is actuated by the front edge of document. Then the belt driving rollers 64*a* to 64*c* and feed roller 65 are actuated and thus the document is fed between the belt 61 and the glass stage 63. The rotation of the belt 61 is stopped as soon as the front edge of document is detected by the sensor 68. In this manner the document is always fed to the exposing position on the glass stage 63 in a correct manner. The document on the glass stage is then exposure-scanned by an optical scanning system (not shown) while the document table and optical system are moved relative to each other and the document image is projected onto the photosensitive drum 10 shown in FIG. 2. After the exposure-scanning step has been finished the belt 60 is driven again and the document is discharged out of the glass stage 63.

According to the invention in order to shift the duplicated image on the record paper in the travelling direction of record paper either one of initiating timings of the document exposure-scanning means and the record paper feeding means is made variable at will with respect to the rotation of photosensitive drum.

Figure 5:
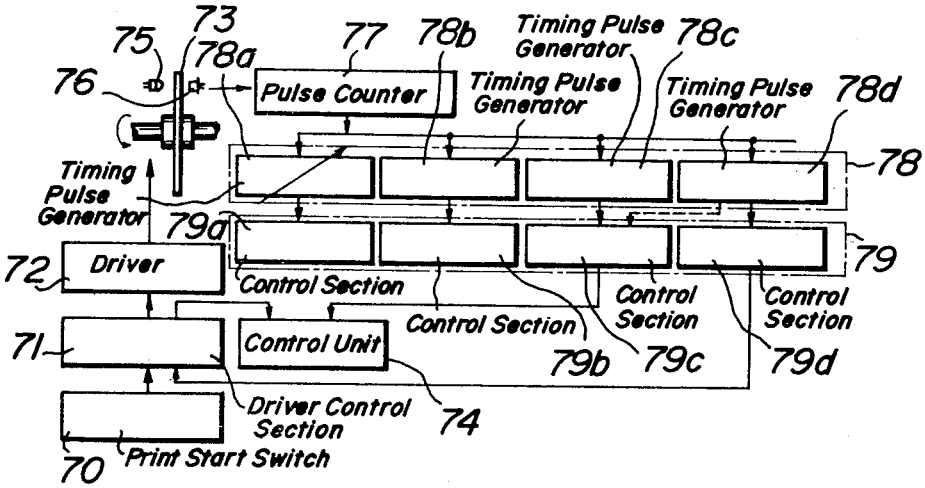
FIG. 5 is a block diagram showing an embodiment of a sequence control device of an electrophotographic apparatus according to the invention.
Figure 6:
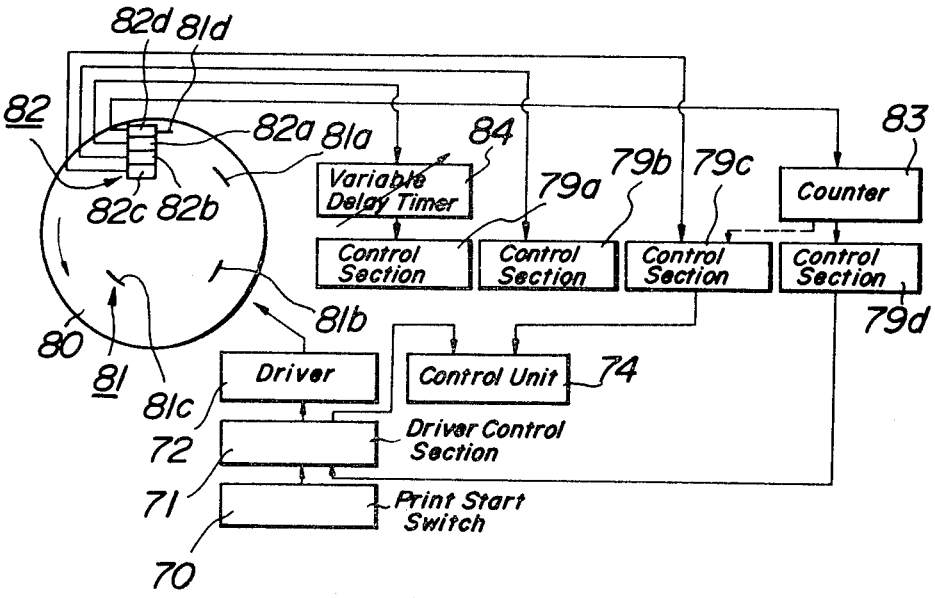
FIGS. 6, 7 and 8 are block diagrams illustrating another embodiments of the sequence control device according to the invention.

FIGS. 5 and 6 are block diagrams illustrating two embodiments of a sequence control device according to the invention. In these embodiments the record paper feeding means are made operative at a fixedly determined timing with respect to the rotational movement of photosensitive drum, but the operational timing of the document exposing and scanning means is made adjustable with respect to the rotation of drum. Now the construction and operation of the sequence control devices shown in FIGS. 5 and 6 will be explained in detail also with reference to FIG. 2.

In FIG. 5 when the document 11 is inserted into the document feed device 13 after the preparation has been completed upon the actuation of the main switch (not shown), the front edge of document is detected by the sensor 20. In this case the sensor 20 serves also as a print start switch 70 shown in FIG. 5. When the print start switch 70 is actuated, a driver control section 71 is made operative to energize a driver section 72 including a driving motor. Then the photosensitive drum 10 is made rotated and a pulse generating disc 73 is also rotated. When the driver control section 71 is energized, a control unit 74 is also made operative and thus the corona charger 23, illumination lamp 22, trimming lamp 25, cleaning device 53, erasing lamp 54, etc. are all energized. Further developing and transferring bias voltages are applied to the developing device 26 and the transferring roller 40, respectively. The pulse generating disc 73 has formed therein a number of holes or slits equidistantly along its periphery. For producing clock pulses in synchronism with the rotation of the drum 10 there are arranged on respective side of the disc 73 a light source 75 consisting of a light emitting diode and a light receiving element 76 such as a photo-diode. These clock pulses are counted by a clock pulse counter 77. A count value of the counter 77 is supplied to a timing pulse generator group 78, each comprising a preset counter and a comparator for comparing the count value with a preset value in the preset counter. The timing pulse generator supplies a timing pulse signal, when the count value of the counter 77 becomes equal to the present value in the related preset counter. Timing pulse generators 78*a*, 78*b*, . . . supply such timing pulses to control sections 79*a*, 79*b*, . . . of a control section group 79. Each control section receives the timing pulse signal from the related timing pulse generator and supplies a control signal to a related portion of the apparatus. For instance, the control section 79*a* is to control the operation of the document exposure-scanning means and is to feed the document 11 which has been stopped at the stand-by position at the sensor 21 onto the glass stage 16 by driving again the document feed rollers 14. The control section 79*b* is to control the feeding of record paper by operating the paper pick-up roller 43 and register rollers 45 at a given timing produced at a given count value of the counter 77 which begins to count the clock pulses as soon as the start switch 70 is actuated. The control section 79*c* is generate various commands for energizing the corona charger 23 and applying the bias voltages to the developing electrode and transferring roller 40. In this embodiment only the single control section 79*c* is provided, but a plurality of control sections may be provided for this purpose. The control section 79*d* is to generate a stop signal for the driver control section 71 on the basis of a detection signal of the number of rotations of drum 10 supplied from the timing pulse generator 78*d*. By means of said stop signal the rotation of drum 10 and operation of various portions which are driven under the control of the timing pulses are stopped. In case of printing a plurality of copies from the same and single electrostatic charge image once formed on the drum 10 by reporting the developing and transferring steps in succession a signal is supplied from the timing pulse generator 78*d* to the control section 79*c* as illustrated by a broken line in FIG. 5 and the various portions which have been made operative by the control unit 74 are made inoperative and various control signals are supplied to various portions in synchronism with the rotation of drum 10.

In the sequence control device illustrated in FIG. 5 the timing pulse generator 78*a* for producing the timing signal for the exposure-scanning operation has a variable preset counter a preset value of which can be changed from the external. That is to say the preset value of the preset counter in the timing pulse generator 98*a* can be adjusted by operating a member provided on an operation panel of the apparatus. In this manner the exposure-scanning timing can be shifted with respect to the other operational timings and thus the position of the toner image on the record paper 41 can be changed in the paper feed direction. In practice, the preset value in the timing pulse generator 98*a* may be simply changed by, for instance, changing a position of a rotary switch or by selectively inserting a socket into any desired one of a plurality of pins. In this manner the start timing of the exposure-scanning can be simply shifted at will with respect to the rotational movement of drum 10 and feeding of the record paper, and thus toner image can be formed at any desired position on the record paper.

In the sequence control device shown in FIG. 6 timing pulses for controlling various portions are derived from a control disc or control cam plate which is directly coupled with the photosensitive drum 10 or is driven in synchronism with the drum 10. To this end a control disc 80 which is rotated in the direction of an arrow together with the drum 10 is provided. The control disc 80 is provided with on its surface a plurality of actuating members 81. These members are secured at given angular positions on concentric circles. There are further provided a plurality of microswitches 82 which are secured to a stationary member (not shown) opposite to the disc 80. Various portions are controlled by signals supplied from these microswitches 82. In FIG. 6 elements which are same or similar to those of FIG. 5 are denoted by the same reference numerals as those shown in FIG. 5. Upon the completion of the preparation the microswitch 82*d* is actuated by the actuating member 81*d* to produce a signal under the control of which a counter 83 is prepared for effecting a counting operation. When a print start switch 70 is made on, a control unit 74 is made operative and the above mentioned operations are carried out. As soon as the photosensitive drum 10 rotates upon the actuation of the start switch 70 the control disc 80 is also rotated in the direction of arrow. After the control disc 80 has rotated by a given angle the microswitch 82*a* is made on by means of the actuating member 81*a* to produce a signal. Upon receipt of this signal a variable delay timer 84 is caused to operate. After a predetermined time has been elapsed a control section 79*a* is made operative to drive the document feed rollers 14 again. Then the document is exposure-scanned. A time period from the actuation of the start switch 70 to the actuation of the microswitch 82*a* is fixedly determined, but a time period from the actuation of the microswitch 82*a* to the timing at which the document is travelled again by the document feed rollers 14, i.e. the start of exposure-scanning can be changed at will by changing the delay time of the timer 84. Therefore by suitably setting the delay time of the delay timer 84 the toner image on the record paper can be adjusted at will in the travelling direction of the record paper. As the variable delay timer 84 use may be made of a motor timer, a CR timer utilizing a charge-discharge of a capacitance, an electronic timer for counting pulses supplied from an oscillator or a main supply frequency. After a given time period has been passed the microswitch 82*b* is made on by the actuator 81*b* to make the control section 79*b* operative, and thus the record paper feeding means including the pick-up roller 43 and the register rollers 45 are made operative. Next the microswitch 82*c* is actuated by the member 81*c* and then the control section 79*c* is made operative. Under the control of this section 79*c* the above mentioned various operations are conducted. When the counter 83 counts the given number of turns of the drum 10, it supplies a signal to a control section 79*d* which stops the operation of driver control section 71 so as to stop the operations of whole apparatus.

Also in this embodiment the sequence control device is so constructed that the various portions of the apparatus can be controlled by the control unit 74 which is controlled by the control section 79*c* which control section 79*c* receives a signal from the counter 83 as shown by a broken line in FIG. 6 in case of printing a plurality of copies from the same and single electrostatic charge image once formed on the photosensitive drum 10.

If the sequence control device shown in FIG. 5 or 6 is applied to the electrophotographic apparatus comprising the document feed device illustrated in FIG. 4, the document table 62 or the exposuring optical system (not shown) is caused to operate by the control section 79*a* so as to initiate the exposure-scanning operation after the document has been fed to the glass stage 63 and stayed thereon. In this case the print start switch 70 for actuating the driver control section 71 may be constituted by the microswitch 67 or the document sensor 68. Alternatively a separate manually operated switch may be provided.

Figure 7:
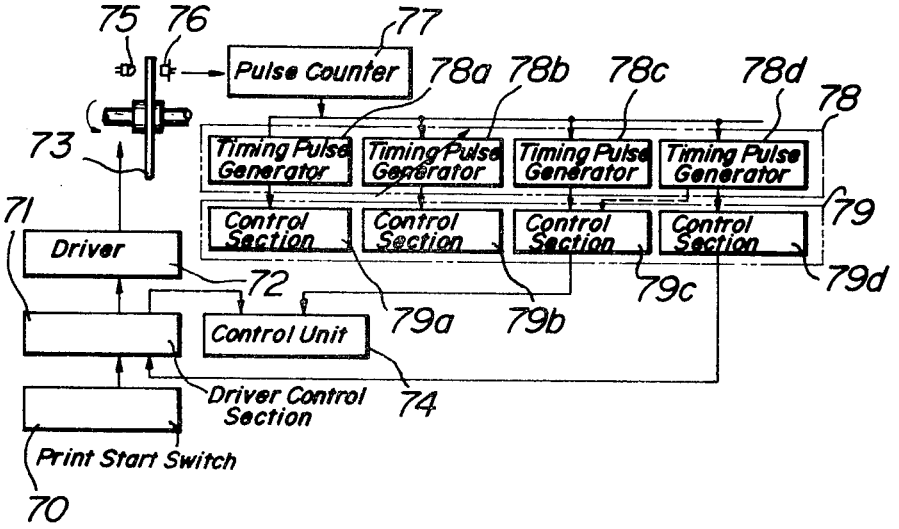
Figure 8:
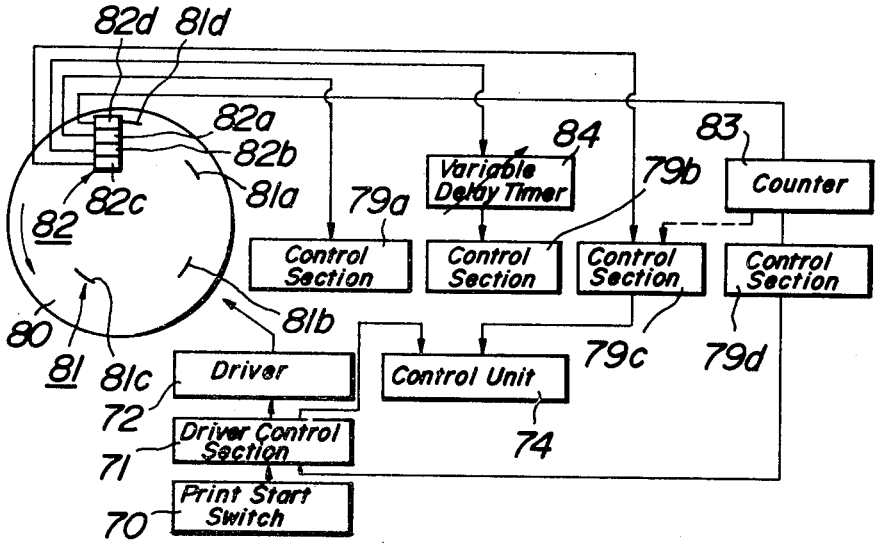

FIGS. 7 and 8 are block diagrams showing another embodiments of the sequence control device according to the invention. In these embodiments the document exposure-scanning means is made operative at a fixed timing with respect to the rotation of the drum 10, but the operational timing of the record paper feeding means can be shifted at will.

The sequence control device illustrated in FIG. 7 has a substantially same construction as that shown in FIG. 5. In this embodiment the preset value of the preset counter in the timing pulse generator 78*a* is not made variable, but the preset value of the preset counter in the timing pulse generator 78*b* is made variable. Therefore the start timing of the document exposure-scanning means defined by the timing pulse generator 78*a* is fixedly set in synchronism with the rotation of drum 10, but the start timing of the record paper feeding comprising the pisk-up roller 43 and register rollers 45 which are controlled by the control section 79*b* under the control of the signal supplied from the preset counter 78*b* can be changed at will. Thus the toner image on the drum 10 can be transferred on the record paper at a desired position. The preset value in the timing pulse generator 78*b* can be easily changed in the same manner as the previous embodiment of FIG. 5.

In the sequence control device shown in FIG. 8 a control section 79*b* is made operative by means of a variable delay timer 84 and other construction and operation are entirely the same as the embodiment of FIG. 6. By changing the delay time of the variable delay timer 84 the start timing of the record paper feeding means can be suitably changed with respect to the rotation of photosensitive drum 10 and thus the toner image can be transferred at a desired position on the record paper 41.

It should be noted that the sequence control devices of FIGS. 7 and 8 may be effectively applied to the electrophotographic apparatus comprising the document feed device illustrated in FIG. 4.

In the embodiments of the invention so far explained the photosensitive drum 10 is made rotated during the formation of the electrostatic charge image, but the present invention may be applied to a so-called one-shot type electrophotographic apparatus in which the electrostatic charge image is formed on the photosensitive member, while the document and photosensitive member are relatively fixed to each other.

Figure 9:
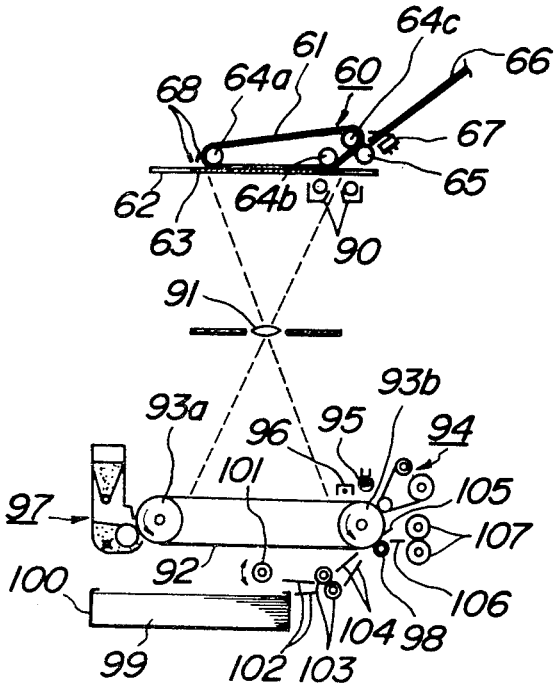
FIG. 9 is a schematic view showing another embodiment of the electrophotographic apparatus to which the present invention can be applied.

FIG. 9 is a schematic view of the electrophotographic apparatus of such a one-shot type. The apparatus comprises a document feed device 60 which is same as that shown in FIG. 4. By means of such a device a document can be fed onto a glass stage 63. Then the image of the document is projected by means of a movably arranged illumination lamp 90 and a fixedly arranged projection lens 91 onto a photosensitive belt 92 which is remained still. The belt 92 is formed as an endless belt which is movably supported by a pair of pulleys 93*a* and 93*b*. The belt 92 has such a length that two document images can be simultaneously formed side by side thereon. Before the document image is projected on the belt, it is rotated by a half turn. During this rotation the photosensitive belt 92 is subjected to a cleaning web 94 and an erasing lamp 95. In this manner residual toners and charge on the belt 92 are removed and then the belt is uniformly charged by a corona charger 96. Therefore when the image of document is projected by moving the illumination lamp 90 on that portion of the belt 92 which has been uniformly charged, the electrostatic charge image corresponding to the document image can be formed on the belt 92. After the exposure has been completed the belt 92 is driven again and the charge image is developed with toners by a developing device 97 which is arranged opposite to the pulley 93*a* with respect to the belt 92. The developing device 97 may be the same as the developing device 26 of FIG. 2. The toner image thus formed is transferred onto a record paper 99 at a transferring section at which a transfer roller 98 is arranged opposite to the pulley 93*b* with respect to the belt 92.

The record paper 99 is supplied from a paper cassette 100 by means of a pick-up roller 101, a pair of paper guides 102, a pair of register rollers 103 and a pair of paper guides 104. The record paper 99 having the toner image transferred thereto is separated from the belt 92 by peeling claws 105 and is fed between a pair of fixing rollers 107. The record paper having the toner image fixed thereon is discharged on a copy tray (not shown).

The belt 92 is further advanced and residual toners and charge thereon are removed by the cleaning web 94 and erasing lamp 95, respectively. When the cleaned portion of the belt 92 becomes a position opposite to the document table 62, the rotation of belt is stopped.

If a next document is inserted into the document feed device 60 after the exposure-scanning for the previous document has been finished, but prior to the developing step, the uniformly charging step for the next document can be effected simultaneously with the developing step for the previous document. In this case the exposure-scanning for the next document can be carried out after the developing step for the first document and the uniformly charging step for the second document have been completed, while the photoconductive belt 92 is stopped temporarily. In this manner copies can be obtained effectively from each of a number of documents. Further in case of inserting a next document into the document feed device 60 after the developing step for the previous document has been started, the uniformly charging step for the next document can be effected simultaneously with the transfer step for the previous document and thus the successive copies of successive documents can be printed in a very efficient manner.

When it is required to obtain a plurality of copies for a single document, the document is remained on the glass stage 63 until the given number of exposure-scanning steps has been completed and two electrostatic charge images are repeatedly formed on the belt 92. In this manner a given number of copies of the same document can be effectively obtained. If the belt 92 has a charge retentive property, after the two charge images have been formed on the belt 92 the document may be discharged out of the document table 62. While two copies of the document can be continuously obtained each time the belt 92 rotates by one turn. In this case if n copies are to be formed, the cleaning web 94 and erasing lamp 95 can be made operative after the completion of the (n−2)th copy, i.e. after the initiation of the (n−1)th copy.

Figure 10:
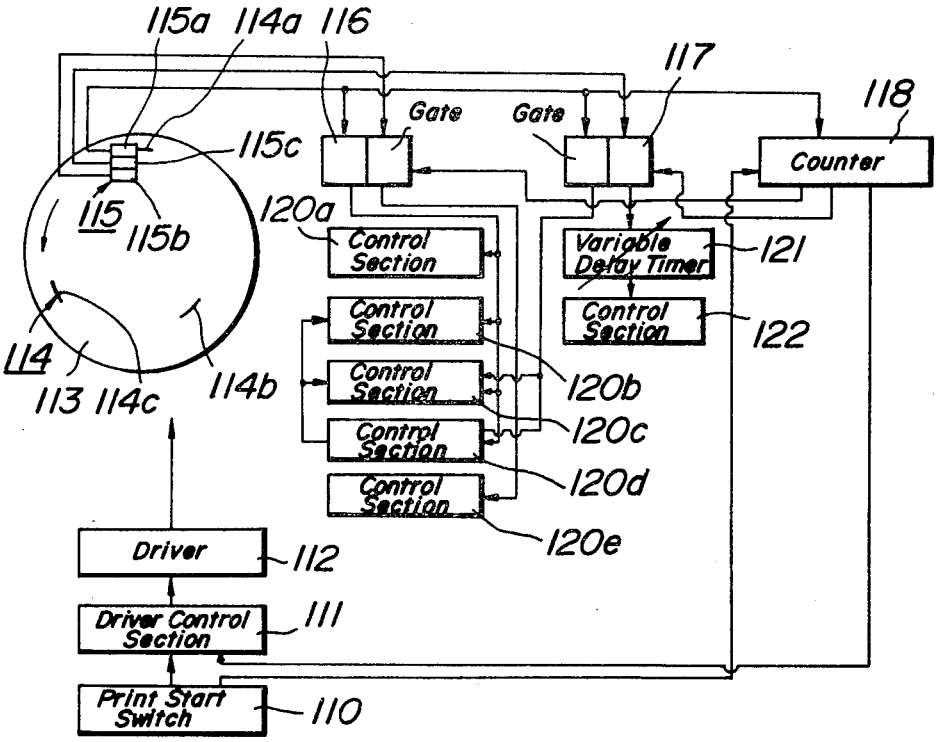
FIG. 10 is a block diagram illustrating still another embodiment of the sequence control device which can be used for the electrophotographic apparatus of FIG. 9.

FIG. 10 is a block diagram illustrating an embodiment of the sequence control device which can be advantageously used in the electrophotographic apparatus of FIG. 9. After the preparation has been completed upon the actuation of a main switch or power switch (not shown) when a print start switch 110 is made on, a driver control section 111 is actuated and then a driver section 112 including a driving motor is energized. The print start switch 110 may be the microswitch 67 provided in the document feed device 60. The switch 110 should be maintained in "ON" state as long as the document is existent in the document feed device 60. A control disc 113 is directly coupled with the driver section 112 and is rotated in the direction of an arrow. On the control disc 113 are arranged a plurality of actuating members 114 which actuate a corresponding number of microswitches 115 arranged on a fixed member (not shown). The actuating members 114 are positioned at given angular positions on concentric circles. When the start switch 110 is made on, the control disc 113 is in a position shown in the drawing. In this position the microswitch **115*a* is actuated by the member 114*a* which supplies a signal to gates 116 and 117 and a counter 118. The counter 118 is to control "ON" or "OFF" condition of the gates 116 and 117 and to stop the operation of driver control section 111 in dependence upon the number of rotations of the disc 113 and whether or not a next document has been inserted into the document feed device 60. During the first rotation of the disc 113 after the actuation of the start switch 110 the gate 116 is opened, but the gate 117 is closed. Upon the rotation of disc 113 the microswitches 115*b* and 115*c* are successively actuated by the member 114*b* and 114*c*, respectively and supply signals to the gates 116 and 117**, respectively.

As soon as the start switch 110 is made on by the insertion of the document to be duplicated control sections **120*a*, 120*b*, 102*c* and 120*d* are caused to operate by the signal from the microswitch 115*a* via the gate 116. Then the belt 61 of document feed device 60 is driven by the control section 120*a*, the corona charger 95 is energized by the control section 120*b*, the erasing lamp 95 is lighted on by the control section 120*c*, and the photosensitive belt 92 is driven by the control section 120*d*. The rotation of the belt 61 is stopped when the front edge of the document is detected by the sensor 68. After the exposure-scanning the belt 61 is rotated again so as to discharge the document. The photosensitive belt 92 may be coupled to the driver section 112 by means of a clutch or may be coupled to a separate driving means. In any case the belt 92 and control disc 113 are so constructed that a single rotation of the disc corresponds to a half rotation of the photosensitive belt 92**.

When the control disc 113 begins to rotate, the microswitch **115*b* is next actuated to supply a signal to the control section 120*e* by means of the gate 116. Thus the illumination lamp 90 is made lighted on. After a given time period from the actuation of the microswitch 115*b* the microswitch 115*c* is actuated, but its signal is not supplied to anywhere, because at this time the gate 117** is made closed.

When the photosensitive belt 92 rotates by a half turn, i.e. the control disc 113 rotates over one turn, the operation of the belt 92, corona charger 95 and erasing lamp 96 are all inhibited by a signal supplied from the sensor (not shown) or a counter 118. At the same time the illumination lamp 90 is moved to exposure-scan the document. The lamp 90 will be lighted off and return to the initial position after the exposure-scanning operation has been finished. It should be noted that even if the photosensitive belt 92 is stopped the control disc 113 continues to rotate.

After the exposure-scanning the control disc 113 will enter into the given number of rotation. Then the microswitch **115*a* makes the gates 116 and 117 off and on, respectively by means of the counter 118. The signal from the microswitch 115*a* is supplied through the gate 117 to the control sections 120*c* and 120*d*. Then the erasing lamp 95 is made lighted on again and the belt 92 is made rotated again so as to initiate the developing step for the electrostatic charge image on the belt 92. If, in this case, a next document has been inserted into the document feed device 60 or the relevant document is remained in order to form a number of copies from the same document, the start switch 110 is remained on. The signal from the start switch 110 is supplied to the counter 118 so that it makes the gates 116 and 117 conductive. Therefore in this case the developing step for the charge image corresponding to the relevant document and the uniformly charging step can be effected simultaneously. In case of forming a number of copies from the single document the document discharge operation of belt 61 of document feed device 60** should be controlled accordingly.

As the control disc 113 further rotates in the given numbered turn the microswitch **115*b* is actuated. In case of multiple-duplication since the gate 116 is made opened the signal from the microswitch 115*b* is supplied to the control section 120*e* which energizes the illumination lamp 90, but in case of single-duplication the gate 116 is made closed and thus the signal is not supplied to the control section 120*e*. Then the microswitch 115*c* is actuated to supply a signal through the gate 117 to a variable delay timer 121. After the delay time of this timer has been elapsed the control section 122 for controlling the operation of the record paper feed means is made operative. Thus the paper pick-up roller 101 and register rollers 103 are driven and the record paper 99 is fed toward the transfer section. In this manner the toner image may be transferred on the record paper at a desired position by suitably adjusting the delay time of the variable delay timer 121. The delay timer 121 may be same as the variable delay timer 84 shown in FIGS. 6 and 8**.

When the control disc 113 has rotated by the desired number of turns, the counter 118 supplies a signal to the driver control section 111 so as to stop the operation of all portions of the apparatus.

As explained above the present invention can be advantageously applied to such an electrophotographic apparatus that the document is exposure-scanned, while the document and photosensitive member are remained still. In the embodiment shown in FIG. 9 the whole surface of the document may be exposed at once by a fixedly arranged lamp and its image may be instantaneously projected on the photosensitive belt 92 instead of moving the illumination lamp 90. Further the transfer roller 93*a* may be arranged opposite to the pulley 93*a* so as to effect the transferring step immediately after the developing step.

According to the present invention the timing for exposure-scanning or record paper feeding can be shifted with respect to the movement of the photosensitive member and use may be made of electric means such as the preset counter, the variable delay timer for changing said timing. Therefore the aim of this invention can be achieved by a simple, but reliable construction.

Figure 1:
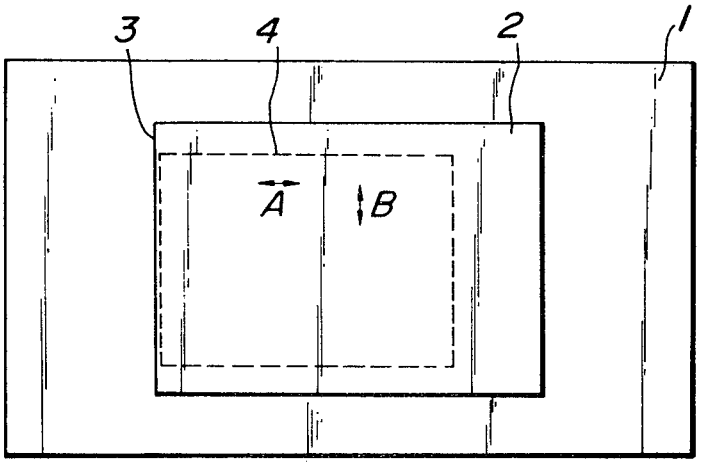
FIG 1 PRIOR ART
FIG. 1 is a plan view showing an embodiment of a known document table for use in an electrophotographic apparatus.

It should be noted that the present invention is not limited to the embodiments explained above, but many modifications could be conceived by those skilled in the art. In the above embodiments the electrostatic charge image is formed on the photosensitive member and after developing step the toner image is transferred to the record paper. But the duplicated image may be obtained by any other processes. For instance, the charge image is once formed on the photosensitive member, a secondary charge image is formed on a separate charge retentive member by means of known TESI method or ion stream modulation method and then the secondary charge image is transferred onto the record paper after being developed with toner. In the above mentioned process the secondary charge image may be directly formed on the record paper. In the above embodiments the driving timing of the document exposure-scanning means or the record paper feeding means is adjusted with respect to the photosensitive member, but the operational timing of the photosensitive member may be controlled with respect to the document exposure-scanning means and the record paper feeding means, or the operational timings of these three members may be mutually adjusted. It should be noted the present invention may be also applied to the electrophotographic apparatus which comprises the document table 2 shown in FIG. 1. According to the invention even placing the document at the given position on the document table the duplicated image can be formed at any desired position on the record paper. Therefore the setting operation of the document on the table becomes quite easy and the image can be recorded at the desired position on the record paper in a very accurate manner. The operational timing of the document exposure-scanning means or the record paper feeding means may be changed in a continuous or stepwise manner. In the sequence control devices illustrated in FIGS. 5 and 7 the variable preset counter may be replaced by a combination of a preset counter and a variable delay timer.

As explained above according to the invention a very useful electrophotographic apparatus can be realized in which the duplicated image can be formed at any desired position on the record paper.

What is claimed is:

1. An electrophotographic apparatus comprising means for exposure-scanning a document to be duplicated to produce an imagewise modulated light ray;

a charge retentive member for retaining an electrostatic charge image formed thereon on the basis of said imagewise modulated light ray;

means for driving the charge retentive member through a transfer section;

means for feeding a record carrier through the transferring section at which the record carrier is positioned opposite to the charge retentive member; and means for transferring the charge image with or without being developed with toners onto the record carrier at said transferring section, the improvements comprising means for shifting at least one operational timings of the exposure-scanning means, the charge retentive member driving means and the record carrier feeding means in such a manner that the charge image can be transferred at any desired position on the record carrier viewed in the feeding direction of record carrier.

2. An electrophotographic apparatus according to claim 1, further comprising a document feeding device for feeding the document to such a given position on a document table that the duplicated image could be formed at a given position on the record carrier, if none of the operational timings of the exposure-scanning means, the charge retentive member driving means and the record carrier feeding means are shifted.

3. An electrophotographic apparatus according to claim 2, wherein said shifting means is so constructed that the operational timings of the exposure-scanning means can be shifted relative to those of the charge retentive member driving means and the record carrier feeding means.

4. An electrophotographic apparatus according to claim 2, wherein said shifting means is so constructed that the operational timing of the record carrier feeding means can be shifted relative to those of the exposure-scanning means and charge retentive member driving means.

5. An electrophotographic apparatus according to claim 3, wherein the charge retentive member is formed by photosensitive material and the document image is projected onto the photosensitive charge retentive member, while the document is fed by the document feed device through an exposure-section at which the exposure-scanning means is fixedly arranged, and said shifting means is so constructed that the operational timings of the document feed device and exposure-scanning means can be adjusted relative to those of the photosensitive member driving means and record carrier feeding means.

6. An electrophotographic apparatus according to claim 5, wherein said document feed device is so controlled that the document is once stopped at an upstream position with respect to the exposure section at a constant speed and said shifting means is so constructed that the timing of initiation of feeding the document from said upstream position can be shifted, whereas the operational timings of the charge retentive member driving means and the record carrier feeding means are fixedly determined in response to a copy start signal.

7. An electrophotographic apparatus according to claim 6, wherein said copy start signal is produced by a document detecting sensor provided at an entrance of the document feed device.

8. An electrophotographic apparatus according to claim 6, wherein said copy start signal is produced by a print start switch.

9. An electrophotographic apparatus according to claim 2, wherein said charge retentive member is formed by photosensitive material, said document feed device is constructed to feed the document to the given position on the document table and then to stop the document thereat, and said exposure-scanning means is made operative to project the document image on the photosensitive member while the document is held at said given position.

10. An electrophotographic apparatus according to claim 9, wherein said shifting means is so constructed that the operational timing of the exposure-scanning can be adjusted, whereas the operational timings of the photosensitive member driving means and record carrier feeding means are fixedly determined in response to a copy start signal.

11. An electrophotographic apparatus according to claim 10, wherein said copy start signal is produced by a document sensor which detects the document fed to said given position on the document table.

12. An electrophotographic apparatus according to claim 10, wherein said copy start signal is produced by a print start switch.

13. An electrophotographic apparatus according to claim 2, wherein the apparatus further comprises a sequence control device for controlling sequentially various portions of the apparatus in synchronism with the charge retentive member driving means, and said shifting means is so constructed to adjust at least one of the operational timings of the exposure-scanning means and record carrier feeding means.

14. An electrophotographic apparatus according to claim 13, wherein said sequence control device comprises a clock pulse generator for producing clock pulses in synchronism with the photosensitive member driving means, a counter for counting the clock pulses, a plurality of preset counters in which given count values have been preset, and a plurality of comparators each of which compares the count value in said counter and the preset value in respective preset counter to produce a timing signal for respective portion of the apparatus, and said shifting means is so constructed to change at least one of the count values in the preset counters which serve to produce the operational timing signals for the exposure-scanning means and record carrier feeding means.

15. An electrophotographic apparatus according to claim 13, wherein said sequence control device comprises a control disc driven in synchronism with the photosensitive member driving means, a plurality of actuating members provided at given angular position on concentric circles on the control disc, and a plurality of switching means fixedly provided opposite to the control disc so as to be driven by the actuating members to produce operational timing signals for various portions of the apparatus, and said shifting means comprises at least one variable delay timer for delaying at least one timing signal supplied from the switching means which serves to produce the timing signal for at least one of the exposure-scanning means and record carrier feeding means.

* * * * *